US006102270A

United States Patent [19]

Robinson

[11] Patent Number: 6,102,270

[45] Date of Patent: Aug. 15, 2000

[54] FUEL INJECTION SYSTEM FOR COMBUSTION-POWERED TOOL

[75] Inventor: James W Robinson, Mundelein, Ill.

[73] Assignee: Illinois Tool Works Inc, Glenview, Ill.

[21] Appl. No.: 09/391,956

[22] Filed: Sep. 8, 1999

Related U.S. Application Data

[62] Division of application No. 08/862,768, May 23, 1997, Pat. No. 5,971,245, which is a division of application No. 08/563,213, Nov. 27, 1995, Pat. No. 5,680,980.

[51] Int. Cl.[7] ..... B25C 1/04; B25C 1/08

[52] U.S. Cl. ..... 227/10; 227/130; 123/465 C

[58] Field of Search ..... 227/10, 8, 130; 123/465 C

[56] References Cited

U.S. PATENT DOCUMENTS

| | | | |
|---|---|---|---|
| 3,967,771 | 7/1976 | Smith | 227/10 |
| 4,483,474 | 11/1984 | Nikolich | 227/10 |
| 5,191,861 | 3/1993 | Kellerman et al. | 227/10 |
| 5,197,646 | 3/1993 | Nikolich | 227/10 |
| 5,263,439 | 11/1993 | Doherty et al. | 123/46 SC |
| 5,687,899 | 11/1997 | Dohi et al. | 227/130 |
| 5,713,313 | 2/1998 | Berry | 123/46 SC |
| 5,752,643 | 5/1998 | MacVicar et al. | 227/130 |
| 5,860,580 | 1/1999 | Velan et al. | 227/10 |
| 5,909,836 | 6/1999 | Shkolnikov et al. | 227/10 |

*Primary Examiner*—Scott A. Smith
*Attorney, Agent, or Firm*—Lisa M. Sehis; Mary W. Croll; John P. O'Brien

[57] ABSTRACT

A fuel system is provided for a combustion-powered tool having a self-contained internal combustion power source with a combustion chamber, and constructed and arranged for driving a drive blade to impact a fastener and drive it into a workpiece. The tool includes a housing having a main chamber enclosing the power source and having a first end adjacent a nosepiece wherein the fasteners are positioned prior to driving, and a second end opposite the first end and adjacent the combustion chamber. A fuel cell chamber is in communication with the main chamber and has a first chamber end corresponding to the first end of the main chamber and a second chamber end corresponding to the second end of the main chamber. A fuel metering valve is disposed in the fuel cell chamber at the first end so that a fuel cell having a fuel outlet end operationally inserted into the fuel cell chamber will engage the valve so that fuel is dispensed into the valve in a location closer to the first chamber end than to the second chamber end.

4 Claims, 2 Drawing Sheets

2
36
48
40
10
34
46
12
18
20
24
115
14
2
50
42a
114
52
54
44
38
28
22
26
XX
76
30
32

FUEL INJECTION SYSTEM FOR COMBUSTION-POWERED TOOL

This is a divisional of application Ser. No. 08/862,768, filed May 23, 1997 now U.S. Pat. No. 5,971,245, which is a divisional of application Ser. No. 08/563,213, filed Nov. 27, 1995, U.S. Pat. No. 5,680,980.

BACKGROUND OF THE INVENTION

The present invention relates to improvements in portable combustion-powered tools, and particularly to a fuel injection system for such a tool.

Portable combustion-powered, or so-called IMPULSE brand tools for use in driving fasteners into workpieces are described in commonly assigned patents to Nikolich U.S. Pat. Re. No. 32,452, and U.S. Pat. Nos. 4,552,162, 4,483,473, 4,483,474, 4,403,722, and 5,263,439, all of which are incorporated by reference herein. Similar combustion-powered nail and staple driving tools are available commercially from ITW-Paslode of Lincolnshire, Illinois under the IMPULSE® brand.

Such tools incorporate a generally pistol-shaped tool housing enclosing a small internal combustion engine. The engine is powered by a canister of pressurized fuel gas, also called a fuel cell. A powerful, battery-powered electronic power distribution unit produces the spark for ignition, and a fan located in the combustion chamber provides for both an efficient combustion within the chamber, and facilitates scavenging, including the exhaust of combustion by-products. The engine includes a reciprocating piston with an elongate, rigid driver blade disposed within a cylinder body.

A valve sleeve is axially reciprocable about the cylinder and, through a linkage, moves to close the combustion chamber when a work contact element at the end of the linkage is pressed against a workpiece. This pressing action also triggers a fuel metering valve to introduce a specified volume of fuel into the closed combustion chamber.

Upon the pulling of a trigger switch, which causes the ignition of a charge of gas in the combustion chamber of the engine, the piston and driver blade are shot downward to impact a positioned fastener and drive it into the workpiece. The piston then returns to its original, or "ready" position through differential gas pressures within the cylinder. Fasteners are fed magazine-style into the nosepiece, where they are held in a properly positioned orientation for receiving the impact of the driver blade.

In some combustion-powered tools, such as that shown in U.S. Pat. No. 5,263,439, the fuel metering valve is located in or near the cylinder head, and as such is affected by heat radiated from the combustion of gases. The combustion chamber and the cylinder body become relatively hot due to this radiated heat. These relatively high temperatures can cause the premature vaporization of the pressurized MAPP fuel at the point of metering the fuel into the combustion chamber. Thus, since vapor, rather than liquid fuel is being metered, fuel volume decreases in the combustion chamber, combustion efficiency suffers accordingly, and the tool will fail to fire. After about 200 rapid fire successive shots, vapor lock often resulted.

Further, combustion-powered tools of this type are designed for use in stressful construction environments, and are often dropped on the ground or have other objects dropped upon them. In addition, construction sites are typically dusty, and although IMPULSE® tools do not require as frequent cleaning as powder activated technology (PAT) tools, it still costs approximately $100 per cleaning, and the operator loses the use of the tool while it is being cleaned. Thus, another design factor of such tools is that the sensitive internal components, such as the fuel metering valve, be protected from shock to extend the cleaning interval.

Another drawback of conventional combustion tools is that the location of the fuel metering valve in the cylinder head of the tool makes it difficult to route the valve control leads.

Accordingly, a first object of the present invention is to provide an improved combustion-powered tool wherein the fuel metering valve is isolated from the heat generated by the combustion chamber.

Another object of the present invention is to provide an improved combustion-powered tool wherein the fuel metering valve is protected from shock impact damage from both tool-generated cylinder impact forces and accidental handling damage.

A further object of the present invention is to provide an improved combustion-powered tool wherein incoming fuel is heated after passing through the metering valve and prior to its entry into the combustion chamber.

A still further object of the present invention is to provide air improved combustion-powered tool wherein fuel is introduced into the combustion chamber in a location from where it can be evenly distributed and may efficiently impact the spark plug.

SUMMARY OF THE INVENTION

The above-identified objects will be met or exceeded by the present fuel injection system for a combustion-powered tool, featuring a fuel container which is inverted relative to conventional designs, thus allowing the placement of the metering valve in a more protected location near the trigger and away from the heat of the combustion chamber. In addition, this placement of the metering valve permits the metered fuel to be heated and to be more effectively vaporized by the heat of the cylinder body or combustion chamber for optimum combustion.

Another feature of the present configuration is that the fuel may be introduced into the combustion chamber in the opposite direction of at least some of the air flow caused by the combustion chamber fan, and is directed at the fan and the spark plug. This is believed to enhance swirling of the fuel within the combustion chamber and the dispersal and migration of the fuel. Yet another advantage of the present invention is that the location of the metering valve near the trigger is also adjacent the central electrical distribution and control unit, which appreciably shortens the required battery lead wires.

More specifically, the present invention provides a combustion-powered tool having a self-contained internal combustion power source with a combustion chamber, the tool being constructed and arranged for driving a driver blade to impact a fastener and drive it into a workpiece. The tool includes a housing having a main chamber enclosing the power source and having a first end adjacent a nosepiece wherein the fasteners are positioned prior to driving, and a second end opposite the first end and adjacent the combustion chamber.

A fuel cell chamber is in communication with the main chamber and has a first chamber end corresponding to the first end of the main chamber and a second chamber end corresponding to the second end of the main chamber. A fuel metering valve is disposed in the fuel cell chamber at the first end so that a fuel cell having a fuel outlet end operationally inserted into the fuel cell chamber will engage the valve so that fuel is dispensed into the valve in a location closer to the first chamber end than to the second chamber end.

In another embodiment, the present invention provides a combustion-powered tool having a self-contained internal combustion power source with a combustion chamber having a spark plug located at one end, the power source being constructed and arranged for driving a driver blade to impact a fastener and drive it into a workpiece. The tool includes a housing having a main chamber enclosing the power source, a cylinder body disposed in the main chamber and including a fuel passageway. The fuel passageway has an end in communication with the combustion chamber so that fuel is emitted from the passageway into the combustion chamber at an end of the combustion chamber opposite the spark plug.

In yet another embodiment, a combustion-powered tool is provided having a self-contained internal combustion power source with a combustion chamber having a spark plug located at a first end. The power source is constructed and arranged for driving a driver blade to impact a fastener and drive it into a workpiece. Included in the tool is a housing having a main chamber enclosing the power source and a separate handle portion releasably connected to the main chamber, the handle portion at least partially defining a fuel cell chamber. A fuel metering valve is located at a first end of the fuel cell chamber so that the valve is protected from at least one of shock damage and extreme heat by the handle portion.

DETAILED DESCRIPTION OF THE PREFERRED EMBODIMENT

Figure 1:
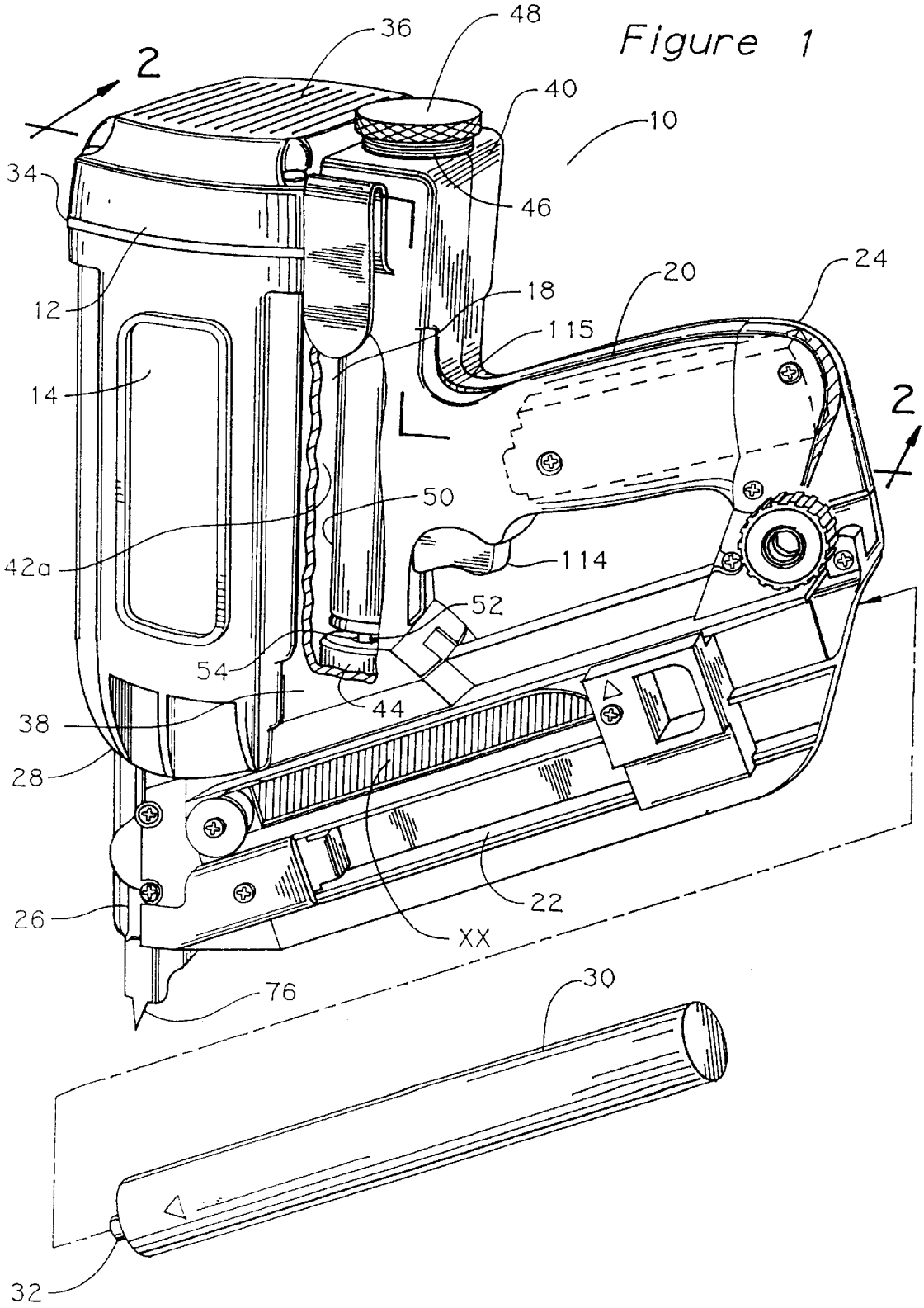
FIG. 1 is a top perspective elevational view of a combustion tool incorporating the present invention, with portions shown partially fragmented and exploded for clarity.
Figure 2:
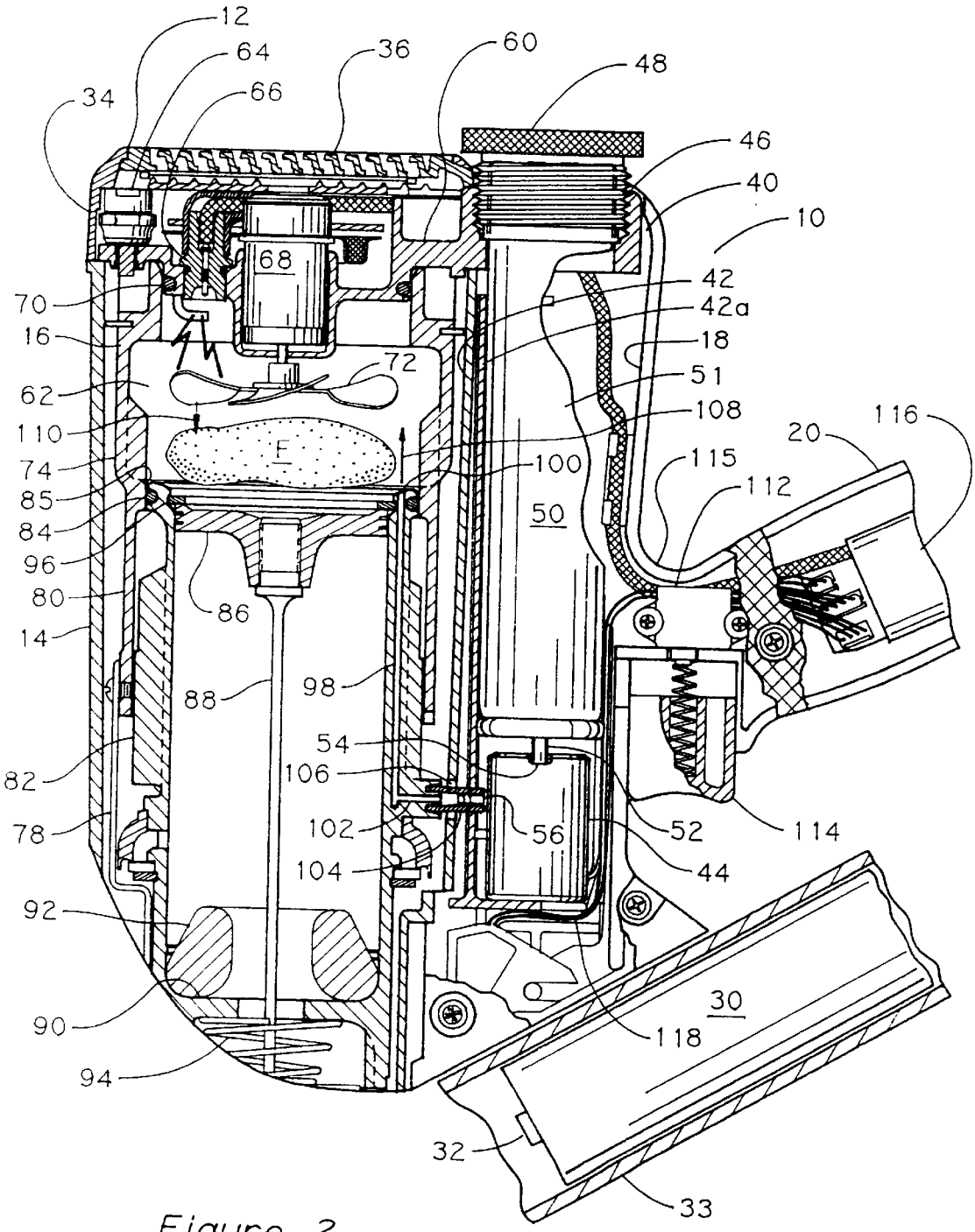
FIG. 2 is a fragmentary vertical sectional view taken along the line 2—2 of FIG. 1 and in the direction generally indicated.

Referring now to FIGS. 1 and 2, a combustion-powered tool of the type suitable for use with the present invention is generally designated 10. The tool 10 has a housing 12 including a main power source chamber 14 dimensioned to enclose a self-contained internal combustion power source 16, a fuel cell chamber 18 generally parallel with and adjacent the man chamber 14, and a handle portion 20 extending from one side of the fuel cell chamber and opposite the main chamber. Actually, the handle portion 20 is a separate component of the housing 12, and includes a handle wall 21 which partially defines the fuel cell chamber 18 (best seen in FIG. 2). The separability of the handle portion facilitates servicing of internal tool components, among other things.

In addition, a fastener magazine 22 is positioned between a butt portion 24 of the handle portion and a nosepiece 26 depending from a first or lower end 28 of the main chamber 14. A battery 30 having a terminal 32 is releasably housed in a tubular compartment 33 (shown fragmentarily in FIG. 2) located on the opposite side of the housing 12 from the fastener magazine 22.

As used herein, "lower" and "upper" are used to refer to the tool 10 in its operational orientation as depicted in FIGS. 1 and 2; however it will be understood that this invention may be used in a variety of orientations depending on the application. Opposite the lower end 28 of the main chamber is a second or upper end 34, which is provided with a plurality of air intake vents 36.

The fuel cell chamber 18 has a first or lower end 38 and a second or upper end 40, each of which corresponds to the respective ends 28, 34 of the main chamber 14. Further, it is preferred that the fuel cell chamber 18 be substantially parallel to the main chamber, and in fact, these chambers share a common wall 42. In a preferred embodiment, an electro-magnetic, solenoid-type fuel metering valve 44 is located at the lower end 38, however it is also contemplated that an injector valve of the type described in commonly-assigned U.S. Pat. No. 5,263,439 would also be suitable. The upper end 40 of the fuel cell chamber is provided with a threaded bore or twist lock access opening 46 into which is engaged a plug 48. In the preferred embodiment, the plug 48 is knurled to facilitate grasping by the user.

Between the plug 48 and the valve 44 is disposed a pressurized fuel canister or fuel cell 50 having an external shell 51 and a nozzle 52. A pressurized liquid hydrocarbon fuel, such as MAPP, and designated F, is contained within an inner chamber and pressurized by a propellant as is known in the art. The cell 50 is disposed in the chamber 18 so that the nozzle 52 engages a corresponding inlet port 54 of the valve 44. An outlet nipple 56 of the valve 44 communicates with the power source 16 as will be described below.

One of the features of the present tool 10 is that the cell 50 and the valve 44 are inverted when compared to conventional combustion-powered tools. This present inverted orientation of the fuel cell and the metering valve, and the surrounding of these components by the handle portion wall 21, isolates the valve from heat generated in the combustion chamber 62, especially as it is radiated to the head 60. Local shock damage to the valve 44, caused by dropping the tool on its head, rough handling or tapping against hard objects, is also prevented by the protected location of the valve. Further, the valve 44 is protected against the repeated shock of combustion due to its location surrounded by the handle portion 20, which, as mentioned above, is a separate component from the main chamber 14. Prior combustion powered tools had the valve located in a position adjacent or mounted to the head 60. Another feature is that infiltration of dust into the main chamber 14 is prevented by the plug 48, which thus extends the interval of time between cleaning of the tool 10.

Referring now to FIG. 2, and returning to the main chamber 14, a cylinder head 60 is disposed at the upper end 34 of the main chamber, and extends laterally into the fuel cell chamber 18, defining the fuel cell opening 46. The cylinder head 60 defines an upper end of a combustion chamber 62, and provides a mounting point for a head switch 64, a spark plug 66, an electric fan motor 68, and a sealing O-ring 70. A fan 72 is attached to an armature of the motor 68, and is located within the combustion chamber to enforce the combustion process and to facilitate cooling and scavenging. The fan motor 68 is controlled by the head switch 64, as disclosed in more detail in the prior patents incorporated by reference.

A generally cylindrical, reciprocating valve member 74 is moved within the main chamber 14 by a workpiece-contacting element 76 (best seen in FIG. 1) on the nosepiece 26 using a linkage 78 in a known manner. Sidewalls of the combustion chamber 62 are defined by the valve member 74, the upper end of which sealingly engages the O-ring 70 to seal the upper end of the combustion chamber. A lower portion 80 of the valve member 74 circumscribes a generally cylindrical cylinder body 82. An upper end of the cylinder body 82 is provided with an exterior O-ring 84, which engages a corresponding portion 85 of the valve member to seal a lower end of the combustion chamber 62.

Within the cylinder body 82 is reciprocally disposed a piston 86 to which is attached a rigid, elongate driver blade 88 used to drive fasteners N (best seen in FIG. 1), suitably positioned in the nosepiece 26, into a workpiece. A lower end of the cylinder body defines a seat 90 for a bumper 92 which defines the lower limit of travel of the piston 86. A spring 94 provides the biasing force to move the valve member downward and open the combustion chamber after ignition and the travel of the drive member to drive the fastener, in a known manner. At the opposite end of the cylinder body 82, a piston stop retaining ring 96 is affixed to limit the upward travel of the piston 86.

Also included within the cylinder body 82 is a fuel injection passageway 98 which runs substantially parallel with the longitudinal axis of the body 82, and is provided with an outlet port 100 opening into the combustion chamber 62 at a lower end thereof, and an angled inlet port 102. The inlet port 102 is preferably disposed at an approximate right angle to the main passageway 98 to properly engage the valve outlet nipple 56.

In the preferred embodiment, a resilient, rubber-like sleeve coupler 104 slidingly engages the outlet nipple 56, and also engages the inlet port 102. An opening 106 in the chamber wall 42 and in the handle wall 21 provides access for the coupler 104. The resilient nature of the coupler 104 accommodates misalignment and vibration due to tool-generated shock (i.e., from combustion), and its insulative character keeps heat away from the valve. At the same time, the coupler 104 is configured to maintain a gas-tight seal between the passageway 98 and the valve 44. In this manner, the valve 44 places the fuel cell 50 in fluid communication with the passageway 98.

An advantage of the location of the passageway 98 is that pressurized fuel F is injected into the inlet port 102, and then is progressively heated by the high temperatures generated in the operation of the power source 16. In fact, the temperature typically reached by the metal of the cylinder body 82 is sufficient to boil and vaporize at least a portion of the fuel prior to its introduction into the combustion chamber 62.

Also, the relatively narrow diameter of the passageway 98, in combination with the high temperatures, increases the velocity of the fuel and speeds its travel to the combustion chamber 62. In this manner, the fuel is injected into the combustion chamber in at least a partially vaporized state, which facilitates combustion.

In addition, the fuel outlet port 100 is located at a lower end of the combustion chamber 62 adjacent the upper limit of travel of the piston 86, and enters the chamber in a direction represented by the arrow 108, which is opposite to the direction of entry of conventional combustion-powered tools. Also, in one embodiment, the port 100 is located at an opposite end of the combustion chamber to the spark plug 66.

Upon injection into the combustion chamber 62, and as a result of the action of the fan, the vaporized fuel will be further vaporized or fragmented. The fuel will circulate throughout the chamber and will reach the spark plug 66. An electrical discharge at the spark gap of the spark plug 66 is initiated by the user by actuating a trigger switch 112 through a trigger 114, which releases a signal from a central electrical distribution and control unit 116. It should be noted that the valve 44 is also located generally adjacent the trigger 114, and is at or below a base 115 of the handle 20 where it meets the fuel cell chamber 18.

Referring now to FIG. 2, another feature of the present tool 10 is that the metering valve 44 is located at a lower end 38 of the fuel chamber 18, which also happens to be in relatively close proximity to the battery terminal 32, as well as the central electrical distribution and control unit 116. As such, the lead wires 118 which connect the battery to a solenoid portion of the valve (not shown), and the control unit 116 to the valve 44, may be made shorter, thus increasing manufacturing and operational efficiency.

While a particular embodiment of the fuel injection system for a combustion-powered tool of the invention has been shown and described, it will be appreciated by those skilled in the art that changes and modifications may be made thereto without departing from the invention in its broader aspects and as set forth in the following claims.

What is claimed is:

1. A combustion-powered tool having a self-contained internal combustion power source with a combustion chamber having a spark plug located at a first end, a second end of said combustion chamber being opposite said first end, the power source being constructed and arranged for driving a driver blade in a first direction to impact a fastener and drive it into a workpiece, comprising:

a housing having a main chamber enclosing the power source and a handle portion releasably connected to said main chamber, a fuel cell chamber disposed in close proximity to said handle portion;

a fuel metering valve located in close proximity to said second end of said combustion chamber for metering fuel into said combustion chamber;

said combustion chamber includes a fan disposed therein to thrust air in said first direction in response to fuel entering said combustion chamber according to the operation of said fuel metering valve.

2. The tool as defined in claim 1 wherein said fuel metering valve is electronic.

3. A combustion-powered tool having a self-contained internal combustion power source with a combustion chamber having a spark plug located at a first end, the power source being constructed and arranged for driving a driver blade to impact a fastener and drive it into a workpiece, comprising:

a housing having a main chamber enclosing the power source and a handle portion releasably connected to said main chamber, a fuel cell chamber disposed in close proximity to said handle portion and having an end in communication with said combustion chamber; and an electronic fuel metering valve located in said fuel cell chamber so that fuel is emitted from said valve into said combustion chamber at an end of said combustion chamber opposite the spark plug.

4. The tool as defined in claim 3 wherein said combustion chamber includes a fan disposed therein to trust air in a first direction, and said passageway communicates with said combustion chamber through an inlet located to introduce fuel into said chamber in the opposite direction to said first direction.

* * * * *